US009696095B2

(12) United States Patent
Lee et al.

(10) Patent No.: US 9,696,095 B2
(45) Date of Patent: Jul. 4, 2017

(54) HEAT EXCHANGER UTILIZING DEVICE TO VARY CROSS SECTION OF HEADER

(71) Applicant: SAMSUNG ELECTRONICS CO., LTD., Suwon-si, Gyeonggi-do (KR)

(72) Inventors: Dong Gyu Lee, Busan (KR); Sung Rok Kim, Seoul (KR); Dong Sik Jin, Hwaseong-si (KR); Kyoung Rock Kim, Suwon-si (KR); Hee Gak No, Annyeong-ri (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 416 days.

(21) Appl. No.: 14/294,340

(22) Filed: Jun. 3, 2014

(65) Prior Publication Data

US 2015/0107296 A1 Apr. 23, 2015

(30) Foreign Application Priority Data

Oct. 21, 2013 (KR) ..... 10-2013-0125406

(51) Int. Cl.
*F28D 1/053* (2006.01)
*F25B 39/02* (2006.01)
*F28F 9/02* (2006.01)

(52) U.S. Cl.
CPC ..... *F28D 1/05325* (2013.01); *F25B 39/028* (2013.01); *F28D 1/05375* (2013.01);
(Continued)

(58) Field of Classification Search
CPC ..... F28D 1/05375; F28D 1/05325; F28D 1/05391; F28F 9/0263; F28F 9/0265; F28F 9/0212; F28F 27/02; F25B 39/028
(Continued)

(56) References Cited

U.S. PATENT DOCUMENTS 3,594,131 A * 7/1971 De Palma ..... B01D 53/944 422/176
3,838,977 A * 10/1974 Warren ..... F01N 3/2846 210/351

(Continued)

FOREIGN PATENT DOCUMENTS

| | | |
|---|---|---|
| DE | 10 2004 035 200 | 2/2005 |
| JP | 3-140764 | 6/1991 |
| JP | 2005-140374 | 6/2005 |

OTHER PUBLICATIONS

European Search Report issued Apr. 7, 2015 in corresponding European Patent Application No. 14174041.5.

*Primary Examiner* — Allen Flanigan
*Assistant Examiner* — Filip Zec
(74) *Attorney, Agent, or Firm* — Staas & Halsey LLP

(57) ABSTRACT

A heat exchanger that effectively distributes a refrigerant by varying the cross-sectional area of a header and an air conditioner having the same. The heat exchanger includes a plurality of refrigerant tubes disposed spaced apart from each other, a header joined to both ends of each of the refrigerant tubes, at least one baffle to divide the refrigerant tubes into a plurality of mutually adjacent groups and block a longitudinal flow of a refrigerant flowing in the header, each of the groups causing the refrigerant to flow in one direction, and a booster installed to vary a cross-sectional area of the header to uniformly distribute the refrigerant to refrigerant tubes in the same group among the refrigerant tubes. The booster to vary the cross-sectional area of the header may allow a refrigerant flowing through a header to be effectively distributed to the refrigerant tubes.

15 Claims, 4 Drawing Sheets

(52) U.S. Cl.
CPC ..... *F28D 1/05391* (2013.01); *F28F 9/0212* (2013.01); *F28F 9/0263* (2013.01); *F28F 9/0265* (2013.01)

(58) Field of Classification Search
USPC ..... 165/286
See application file for complete search history.

(56) References Cited

U.S. PATENT DOCUMENTS 5,186,249 A 2/1993 Bhatti et al.
7,931,073 B2 * 4/2011 Gorbounov ..... F25B 39/028 165/174

* cited by examiner

HEAT EXCHANGER UTILIZING DEVICE TO VARY CROSS SECTION OF HEADER

CROSS-REFERENCE TO RELATED APPLICATIONS

This application claims the benefit of Korean Patent Application No. 10-2013-0125406, filed on Oct. 21, 2013 in the Korean Intellectual Property Office, the disclosure of which is incorporated herein by reference.

BACKGROUND

1. Field

Embodiments of the present disclosure relate to a heat exchanger that effectively distributes a refrigerant by varying the cross-sectional area of a header and an air conditioner having the same.

2. Description of the Related Art

An air conditioner generally uses a refrigeration cycle to adjust temperature, humidity, airflow direction and air distribution, and also removes dust from the air to provide an environment suitable for humans. Main constituents configuring the refrigeration cycle include a compressor, a condenser, an evaporator, an expansion valve, and a fan.

Air conditioners may be classified into split type air conditioners having an indoor unit and an outdoor unit separately installed, and integrated type air conditioners having an indoor unit and an outdoor unit installed together in one cabinet. For a split type air conditioner, the indoor unit thereof includes a heat exchanger to exchange heat with air suctioned through a panel, and a fan to suction the indoor air and blow the suctioned air out to the indoor space.

A heat exchanger, a device constituting an air conditioner, may function as a condenser or an evaporator. The heat exchanger may be provided with a refrigerant pipe to guide a refrigerant, and the refrigerant pipe may be coupled to multiple heat exchange fins to increase heat exchange efficiency.

A heat exchanger having a microchannel refrigerant tube is known to have a better heater transfer property than other types of heat exchangers, and is thus used for air conditioners. However, since the refrigerant undergoes phase change as it flows along the microchannel refrigerant tube, the refrigerant may not be uniformly distributed throughout the refrigerant tube.

Moreover, ineffective distribution of the refrigerant throughout the refrigerant tube may prevent complete use of the refrigerant tube provided to the heat exchanger. As a result, the heat exchange efficiency and performance of the heat exchanger may be degraded, and the air conditioner may not be optimally operated.

SUMMARY

Therefore, it is an aspect of the present disclosure to provide a heat exchanger that may effectively distribute a refrigerant to a plurality of refrigerant tubes, and an air conditioner having the same.

Another aspect of the present disclosure is to provide a heat exchanger provided, at one side of a header, with a booster to vary the cross-sectional area of the header, and an air conditioner having the same.

Additional aspects of the disclosure will be set forth in part in the description which follows and, in part, will be apparent from the description, or may be learned by practice of the disclosure.

In accordance with one aspect of the present disclosure, a heat exchanger includes a plurality of refrigerant tubes disposed spaced apart from each other, a header joined to both ends of each of the refrigerant tubes, at least one baffle to divide the refrigerant tubes into a plurality of mutually adjacent groups and block a longitudinal flow of a refrigerant flowing in the header, each of the groups causing the refrigerant to flow in one direction, and a booster installed to vary a cross-sectional area of the header to uniformly distribute the refrigerant to refrigerant tubes in the same group among the refrigerant tubes.

The booster may include a casing installed at one side of the header, a blocking plate positioned inside the casing and installed to be movable into the header, and an elastic unit to elastically bias the blocking plate.

The blocking plate may be positioned at a location where the refrigerant tubes are divided into different groups.

The booster may include an introduction port connecting the header to the casing to allow the refrigerant flowing in the header to enter the casing.

The booster may further include a connection plate to move according to introduction of the refrigerant into the casing through the introduction port, wherein one side of each of the blocking plate and the elastic unit may be fixed to the connection plate such that the blocking plate and the elastic unit move along with the connection plate.

The booster may further include a guide plate installed inside the casing in a protruding manner to allow the refrigerant introduced through the introduction port to apply pressure to the connection plate to cause the connection plate to stably move.

The booster may include a guide protrusion positioned at upper and lower portions of the blocking plate and protruding into the header to allow the blocking plate to stably move.

In accordance with another aspect of the present disclosure, an air conditioner includes a compressor to compress and discharge a gaseous refrigerant, an expansion valve to expand a condensed liquid refrigerant, and a heat exchanger provided with a plurality of refrigerant tubes disposed spaced apart from each other and a header joined to both ends of each of the refrigerant tubes, wherein the header may include at least one baffle to block a longitudinal flow of a refrigerant flowing in the header and a booster installed to vary a cross-sectional area of the header.

The booster may include a blocking plate installed to move using pressure of the refrigerant flowing in the header.

The booster may further include an elastic unit to elastically bias the blocking plate.

The blocking plate may be positioned at one side of the header and arranged between the refrigerant tubes disposed spaced apart from each other.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
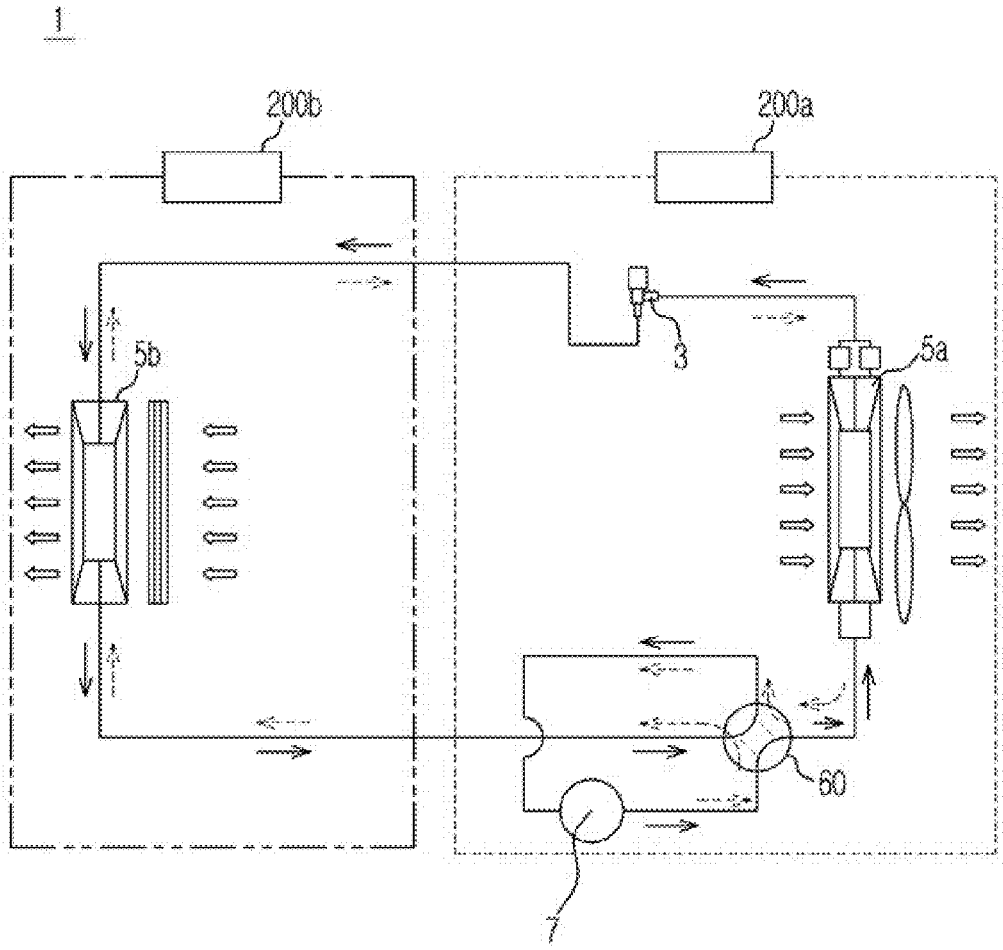
FIG. 1 is a view illustrating a refrigerant cycle of air conditioner according to one embodiment of the present disclosure.

Reference will now be made in detail to the embodiments of the present disclosure, examples of which are illustrated in the accompanying drawings, wherein like reference numerals refer to like elements throughout.

FIG. 1 is a view illustrating a refrigerant cycle of air conditioner according to one embodiment of the present disclosure.

A refrigerant cycle constructing the air conditioner 1 includes a compressor 7, a condenser, an expansion valve 3, and an evaporator. The refrigerant cycle may cause a refrigerant circulating through a series of processes of compression, condensation, expansion, and evaporation to exchange heat with air to supply conditioned air to the indoor space.

The compressor 7 compresses a gaseous refrigerant to a high temperature and a high pressure and then discharges the same. The discharged gaseous refrigerant is introduced into the condenser. The condenser may condense the compressed refrigerant into liquid and dissipate heat into surroundings through the condensation process, thereby achieving heating.

The expansion valve 3 expands the liquid refrigerant of high temperature and high pressure produced through condensation in the condenser such that the liquid refrigerant of lower pressure is produced. The evaporator evaporates the refrigerant having expanded through the expansion valve 3, and returns the gaseous refrigerant of lower temperature and low pressure to the compressor 7. The evaporator may achieve cooling effect through heat exchange with an object to be cooled using the latent heat of evaporation of the refrigerant. Through such refrigeration cycle, the air conditioner 1 may adjust the temperature of air in an indoor space.

The outdoor unit 200*a* of the air conditioner 1 is a part of the refrigeration cycle provided with a compressor 7 and an outdoor heat exchanger 5*a*. The expansion valve 3 may be arranged in one of the indoor unit 200*b* and the outdoor unit 200*a*, and the indoor heat exchanger 5*b* may be arranged in the indoor unit 200*b* of the air conditioner 1.

The indoor heat exchanger 5*b* and the outdoor heat exchanger 5*a* may be the same type of heat exchangers 5. When the refrigerant changes from gas to liquid, the heat exchangers 5 may be used as condensers. When the refrigerant changes from liquid to gas, the heat exchangers 5 may be used as evaporators. Each of the outdoor heat exchanger 5*a* and the indoor heat exchanger 5*b* may be used as one of the condenser and the evaporator. In the case that the outdoor heat exchanger 5*a* functions as a condenser, the indoor heat exchanger 5*b* is used as an evaporator. In the case that the outdoor heat exchanger 5*a* functions as an evaporator, the indoor heat exchanger 5*b* may be used as a condenser.

The refrigerant cycle indicated by a solid line in FIG. 1 represents a cooling cycle of cooling the indoor space. In this cycle, the outdoor heat exchanger 5*a* serves as a condenser, and the indoor heat exchanger 5*b* serves as an evaporator. The refrigerant compressed into a high-temperature and high-pressure gaseous refrigerant by the compressor 7 is introduced into the outdoor heat exchanger 5*a*. The outdoor heat exchanger 5*a* serves as a condenser to condense the gaseous refrigerant into a liquid refrigerant and dissipate the produced heat to the indoor air. After the outdoor heat exchanger 5*a*, the liquid refrigerant expands at the expansion valve 3 and flows into the indoor heat exchanger 5*b*. The indoor heat exchanger 5*b* evaporates the liquid refrigerant in a gaseous refrigerant, absorbing heat from the indoor air to cool the indoor space.

The refrigerant cycle indicated by a dotted line in FIG. 1 represents a heating cycle of heating the indoor space. In this cycle, the outdoor heat exchanger 5*a* serves as an evaporator, and the indoor heat exchanger 5*b* serves as a condenser. In this cycle, the refrigerant moves in the direction opposite to that of movement of the refrigerant in the refrigeration cycle indicated by the solid line. The gaseous refrigerant leaving the compressor 7 is introduced into the indoor heat exchanger 5*b*. Accordingly, the indoor heat exchanger 5*b* may dissipate heat into indoor air to heat the indoor space. The indoor heat exchanger 5*b* condenses the gaseous refrigerant into liquid refrigerant and sends the condensed refrigerant to the expansion valve 3. After passing through the expansion valve 3, the refrigerant undergoes phase change in the outdoor heat exchanger 5*b* and turns into gaseous refrigerant.

A refrigerant diversion unit 60 may divert the direction of flow of the refrigerant such that the refrigerant cycle is used as a heating cycle and a cooling cycle. The refrigerant diversion unit 60 allows the refrigerant to flow clockwise or counterclockwise, and accordingly the air conditioner 1 may be used as a cooling/heating air conditioner for both cooling and heating of the indoor air. The refrigerant diversion unit 60 may be disposed between the compressor 7 and the outdoor heat exchanger 5*a*. The refrigerant diversion unit 60 may be arranged adjacent to the compressor 7, which is the most influential part of the refrigerant cycle of the air conditioner 1, to more easily divert the flow direction of the refrigerant.

Figure 2:
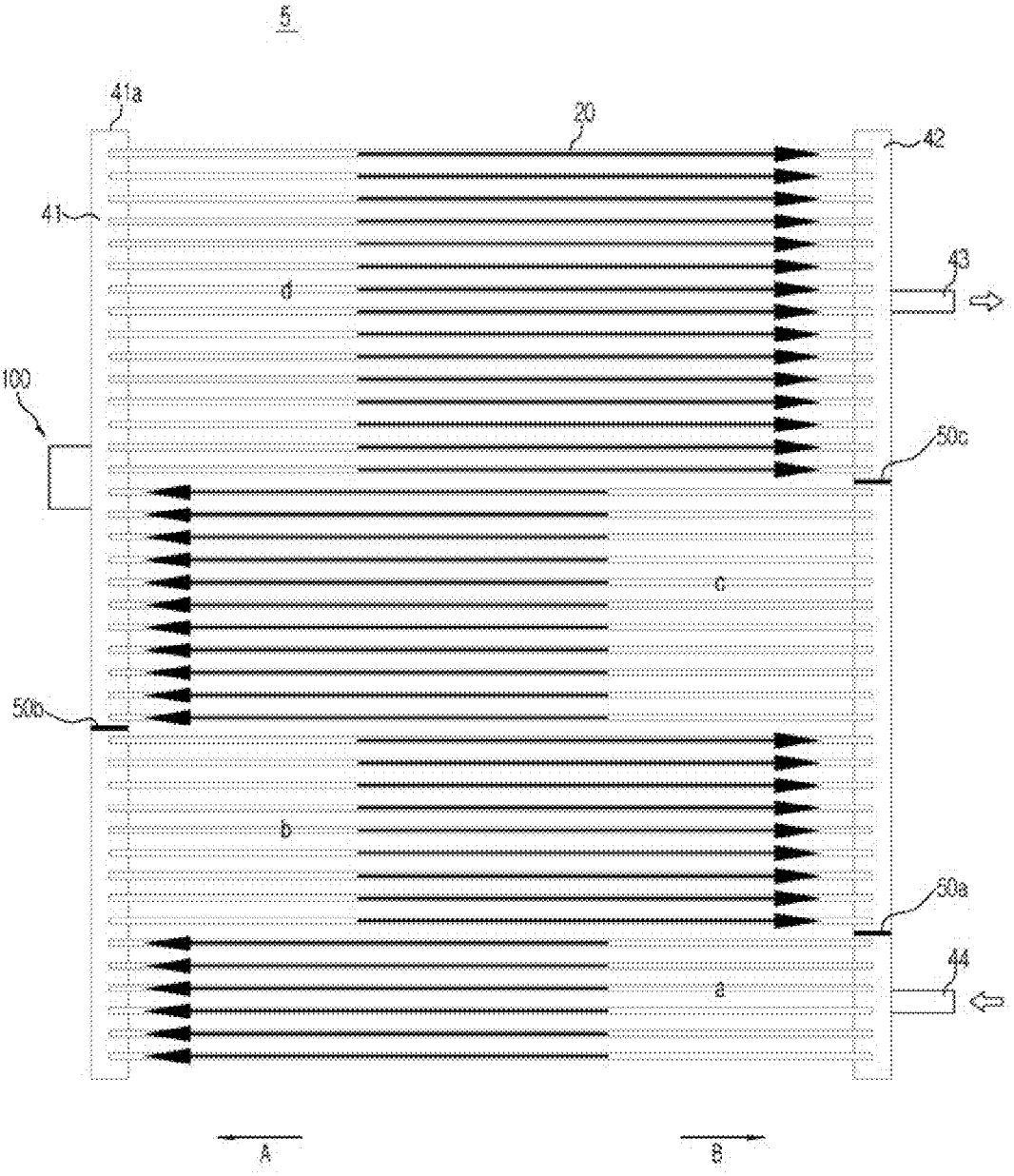
FIG. 2 is a view illustrating a heat exchanger according to one embodiment of the present disclosure.

FIG. 2 is a view illustrating a heat exchanger 5 according to one embodiment of the present disclosure.

The heat exchanger 5 includes a plurality of refrigerant tubes 20 spaced apart from each other and headers 41 and 42 coupled to both ends of each of the refrigerant tubes 20. Refrigerant pipes 43 and 44 connected to another refrigerant cycle unit to allow inflow and outflow of the refrigerant therethrough may be joined to one side of the headers 41 and 42.

The headers 41 and 42 may include a first header 41 and a second header 42 joined to both ends of each of the refrigerant tubes 20. The refrigerant pipes 43 and 44 may include a first refrigerant pipe 43 installed at one side of the upper portion of the second header 42 and a second refrigerant pipe 44 installed at one side of the lower portion of the second header 42. One side of the first refrigerant pipe 43 may be connected to the compressor 7, and one side of the second refrigerant pipe 44 may be connected to the expansion valve 3.

In the case that the refrigerant is introduced through the first refrigerant pipe 43 and discharged through the second refrigerant pipe 44, the heat exchanger 5 may function as a condenser. On the other hand, in the case that the refrigerant is introduced through the second refrigerant pipe 44 and discharged through the first refrigerant pipe 43, the heat exchanger 5 may function as an evaporator. FIG. 2 shows a heat exchanger 5 used as an evaporator in which the refrigerant is introduced through the second refrigerant pipe 44 for heat exchange and discharged through the first refrigerant pipe 43.

The first header 41 and the second header 42 are joined to both ends of each of the refrigerant tubes 20. The refrigerant may flow along the refrigerant tubes 20 communicating with each other through the first header 41 and the second header 42. The refrigerant tubes 20 extend as long as possible to increase the area for heat exchange between the refrigerant and the external air, but extension thereof in a longitudinal direction is spatially restricted. Accordingly, the first header 41 and the second header 42 may be provided with baffles 50*a*, 50, 50*c* joined to both ends of the refrigerant tubes 20 to divert the refrigerant.

At least one of the baffles 50*a*, 50*b*, 50*c* may be installed to block the longitudinal flow of the refrigerant flowing in the headers 41 and 42. The baffles 50*a*, 50*b*, 50*c* may be installed in the first header 41 and the second header 42 and spaced a certain distance from each other. As shown in FIG. 2, the baffles 50*a*, 50*b*, 50*c* may be alternately arranged in the first header 41 and the second header 42 to allow the refrigerant to flow along the refrigerant tubes 20 in alternating directions and then pass through the heat exchanger 5. By the baffles 50*a*, 50*b*, 50*c* diverting the flow direction of the refrigerant, refrigerant tubes 20 may be divided into a plurality of adjacent groups. In the refrigerant tubes from the same group, the refrigerant flows in the same direction.

A first direction A is defined as the direction in which the refrigerant is directed from the second header 42 toward the first header 41, and a second direction B is defined as the direction in which the refrigerant is directed from the first header 41 to the second header 42. As shown in FIG. 2, the refrigerant introduced through the second refrigerant pipe 44 flows through the refrigerant tubes 20 in the first direction A. The first baffle 50*a* positioned in the second header 42 causes the refrigerant to move along the refrigerant tubes 20 in the first direction A without flowing to the upper portion of the second header 42. After moving to the first header 41 positioned at the end of the path in the first direction A, the refrigerant is introduced into the first header 41 by pressure, and then caused to flow in the second direction B by the second baffle 50*b* positioned in the first header 41.

The refrigerant flowing in the second direction B moves again to the second header 42, and is prevented from moving to the lower portion of the second header 42 by the first baffle 50*a*. The third baffle 50*c* positioned over the first baffle 50*a* in the second header 42 may divert the refrigerant again to the first direction A. That is, in the inner space of the second header having the lower portion closed by the first baffle 50*a* and the upper portion closed by the third baffle 50*c*, the refrigerant enters the inner space in the second direction B and leaves the space in the first direction A. Flowing out of the second header 42 in the first direction A, the refrigerant enters the first header 41 and is prevented from flowing downward by the second baffle 50*b*. The refrigerant diverted by the closed end portion 41*a* of the first header 41 flows in the second direction B and leaves the first header 41 through the first refrigerant pipe 43.

The number and positions of the baffles positioned in the first header 41 and the second header 42 are selectable. The baffles may be alternately positioned in the first header 41 and the second header 42 such that the refrigerant moves alternately in the first direction A and the second direction B.

The refrigerant tubes 20 of the heat exchanger 5 shown in FIG. 2 may be divided, by the baffles 50*a*, 50*b*, 50*c*, into four groups in which the refrigerant flows in the first direction A or the second direction B. A group of the refrigerant tubes in which the refrigerant introduced into the heat exchanger 5 through the second refrigerant pipe 44 flows in the first direction A is defined as a first group a. In sequential order of flow directions of the refrigerant, the other refrigerant tubes may be divided into a second group b having the refrigerant flowing in the second direction B, a third group having the refrigerant in the first direction A, and the fourth group d having the refrigerant flowing to the first refrigerant pipe 43 in the second direction B.

The refrigerant introduced through the second refrigerant pipe 44 in a liquid state changes to gas through heat exchange and flows out to the first refrigerant pipe 43 as a gaseous refrigerant. On the other hand, when refrigerant is introduced through the first refrigerant pipe 43 and discharged to the second refrigerant pipe 44, the refrigerant undergoes phase change from gas to liquid.

Since the liquid refrigerant has a smaller volume than a gaseous refrigerant of the same mass, the number of refrigerant tubes 20 mostly containing liquid refrigerant may be set to be small. That is, the same amount of refrigerant flows through the refrigerant tubes 20 of each group to perform heat exchange, but the first group a in which a major portion of the refrigerant flowing through the refrigerant tubes 20 is liquid refrigerant has a smaller number of refrigerant tubes 20. On the other hand, the fourth group d in which a major portion of the refrigerant flowing through the refrigerant tubes 20 is gaseous refrigerant has the greatest number of refrigerant tubes 20 among all groups. The heat exchanger 5 is disposed such that the number of refrigerant tubes 20 increases in order from the first group a to the fourth group.

Figure 3:
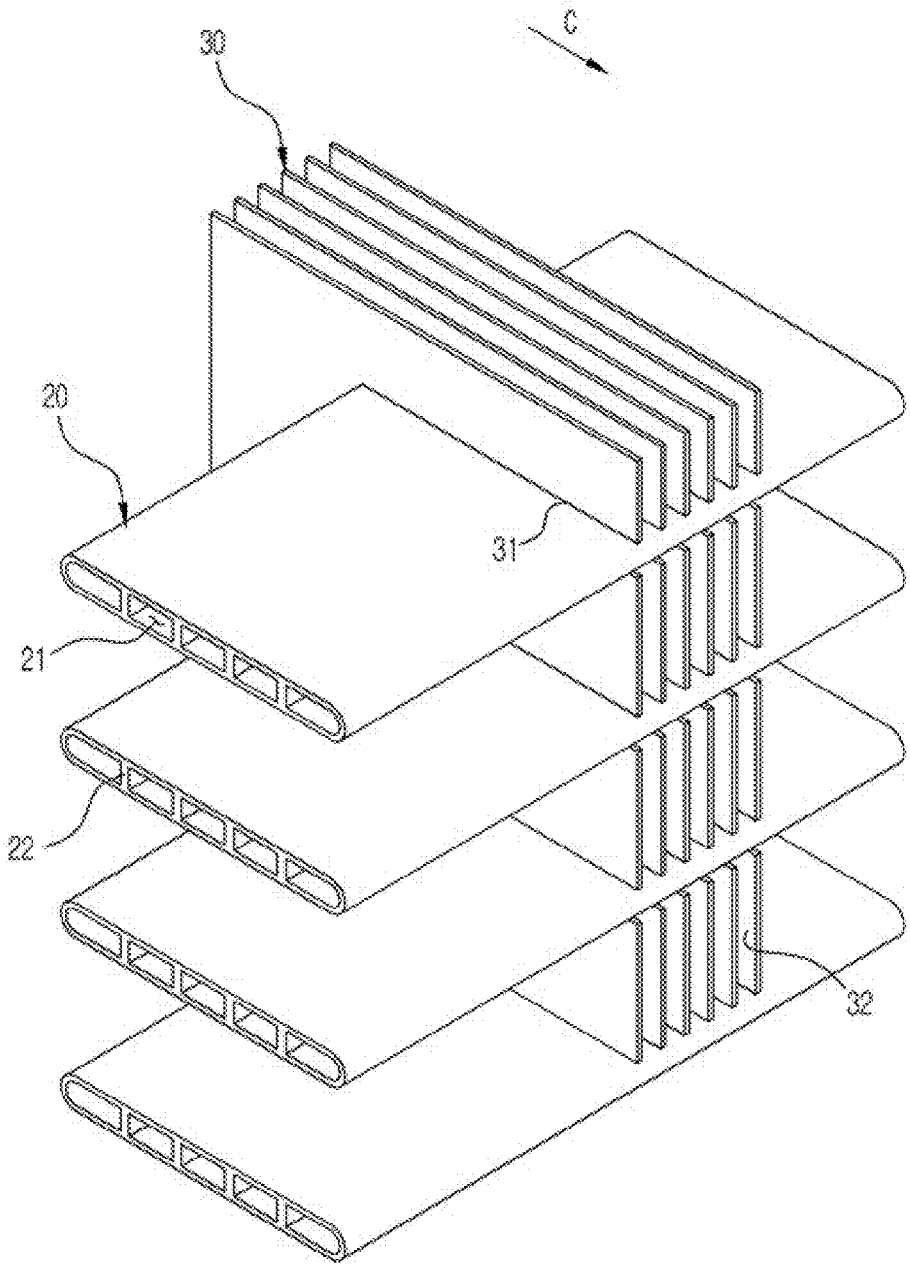
FIG. 3 is a view illustrating a refrigerant tube of a heat exchanger according to one embodiment of the present disclosure.

FIG. 3 is a view illustrating the refrigerant tubes 20 of the heat exchanger 5 according to one embodiment of the present disclosure.

The refrigerant tubes 20 include a plurality of flow channels 21 hollowed to allow the fluid refrigerant to flow therethrough, and partition walls 22 to divide the flow channels 21. The flow channels 21 are spaced apart from each other in the widthwise direction of the refrigerant tubes 20.

Microchannel refrigerant tube may be used as the refrigerant tubes 20. The microchannel refrigerant tubes 20 are tubes whose hydraulic diameter is equal to or less than 3 mm. The hydraulic diameter may be found by dividing the cross-sectional area of a tube by the circumference thereof.

The refrigerant may dissipate or absorb heat to or from the surroundings by compressing or expanding as it flows along the flow channels 21 formed in the refrigerant tubes 20. To allow the refrigerant to efficiently dissipate or absorb heat through compression or expansion, heat exchange fins 30 are joined to the refrigerant tubes 20.

A plurality of heat exchange fins 30 may be disposed spaced a predetermined distance from each other in a direction C perpendicular to the direction in which the refrigerant tubes 20 extend. The direction C, in which the heat exchange fins 30 are inserted into the refrigerant tubes 20, the first direction A, and the second direction B are perpendicular to each other. The heat exchange fins 30 may be formed of an aluminum alloy having a high thermal conductivity. The heat exchange fins 30 may be bonded to the outer surface of the refrigerant tubes 20, thereby serving to substantially increase the area of the refrigerant tubes 20 for exchange of heat with external air.

When the space between the stacked heat exchange fins 30 is narrowed, a larger number of the heat exchange fins 30 may be disposed. However, in the case the space between the heat exchange fins 30 is excessively narrow, they may resist inflow of external air toward the heat exchanger 5. This may result in pressure loss. Accordingly, space between the heat exchange fins 30 may be properly adjusted.

The heat exchange fins 30 may include a plurality of insertion grooves 31 into which the refrigerant tubes 20 are inserted, and a plurality of the bonding plates 32 bonded to refrigerant tubes 20 with the refrigerant tubes 20 inserted into the insertion grooves 31.

The insertion grooves 31 may be formed in a shape corresponding to a portion of the heat exchange fins 30 to allow at least one portion of the heat exchange fins 30 to be inserted thereinto. In addition, they may be formed between the bonding plates 32 spaced apart from each other in the direction of extension of the heat exchange fins 30. The heat exchange fins 30 may be formed in any shape allowing efficient dissipation or absorption of heat by the refrigerant tubes 20.

Figure 4:
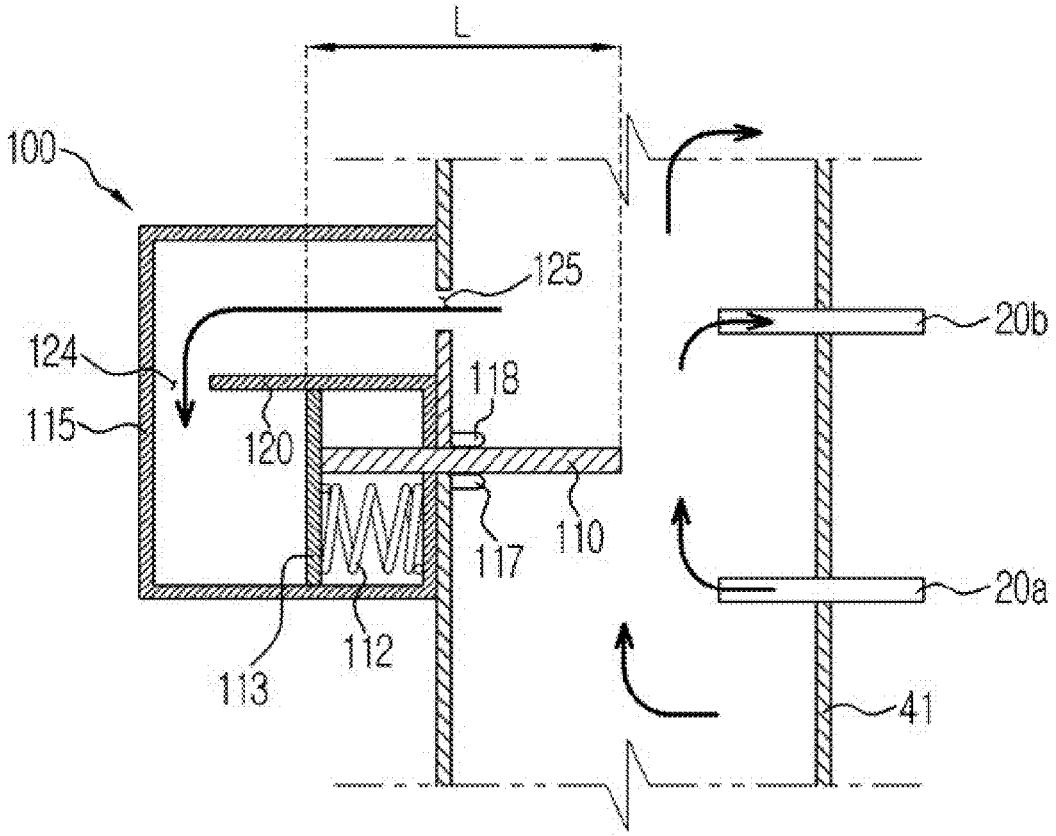
FIG. 4 is a view illustrating a booster of a heat exchanger according to one embodiment of the present disclosure.

FIG. 4 is a view illustrating a booster 100 of a heat exchanger 5 according to one embodiment of the present disclosure.

Since each of the refrigerant tubes 20 has a plurality of flow channels 21 having a relatively small diameter as discussed above, the refrigerant introduced into the headers 41 and 42 may not be uniformly distributed to the refrigerant tubes 20. Particularly, when dryness increases according to phase change of the refrigerant, distribution of the refrigerant to the refrigerant tubes 20 may become difficult.

In the case of a variable rate-of-rotation compressor 7, the velocity of flow of the refrigerant may vary depending on operation of the compressor 7. When the compressor 7 is operated at a relatively low rate of rotation, the internal pressure of the header 41 increases and the velocity of flow of the refrigerant decreases. On the other hand, when the compressor 7 is operated at a relatively high rate of rotation, the internal pressure of the header 41 decreases and the velocity of flow of the refrigerant increase.

As such, distribution of the refrigerant to the refrigerant tubes 20 may vary depending on the velocity of flow of the refrigerant. When the velocity of flow of the refrigerant is high, the refrigerant may be concentrated in the upper refrigerant tubes 20 among the refrigerant tubes 20 from the same group. On the other hand, when the velocity of flow of the refrigerant is low, the refrigerant may be concentrated in the lower refrigerant tubes 20 among the refrigerant tubes 20 from the same group.

A property of distribution of the refrigerant to the refrigerant tubes 20 from the same group is associated with the mass flow rate of the refrigerant and the effective cross-sectional areas of the headers 41 and 42. According to this embodiment, by using the booster 100 to adjust the effective cross-sectional areas of the headers 41 and 42 the distribution property of the refrigerant may be enhanced.

The booster 100 may include a casing 115 installed at one side of the headers 41 and 42, a blocking plate 110 positioned inside the casing 115 and installed to move into the headers 41 and 42, and an elastic unit 112 to elastically bias the blocking plate 110.

The booster 100 may be installed at the upper side of the headers 41 and 42 containing a large amount of the gaseous refrigerant having a degraded distribution property. Particularly, the booster 100 may be positioned at a place where the refrigerant tubes 20 are divided into different groups. As shown in FIG. 2, the booster 100 may be attached to one side of the first header 41 at which the refrigerant tubes 20 are divided into the third group c and the fourth group d. Hereinafter, the first header 41 will be referred to as the header for simplicity of description.

The blocking plate 110 may be movably installed inside the header 41 to vary the cross-sectional area of the header 41. The blocking plate 110 may be positioned between the refrigerant tubes 20 spaced apart from each other. Particularly, the blocking plate 110 may be disposed between the refrigerant tube 20*a* positioned at the uppermost part of the third group c and the refrigerant tube 20*b* positioned at the lowermost part of the fourth group d. That is, the blocking plate 110 is installed in the passage in which the refrigerant having passed through the third group c is collected to move to the fourth group d.

To allow the refrigerant flowing through the header 41 to enter the casing 115, the booster 100 may include an introduction port 125 connecting the header 41 to the casing 115. The refrigerant introduced through the introduction port 125 may move a connection plate 113 to which the blocking plate 110 and the elastic unit 112 are connected by applying pressure to the connection plate 113. One side of each of the blocking plate 110 and the elastic unit 112 may be fixed to the connection plate 113. Accordingly, the blocking plate 110 and the elastic unit 112 may move along with the connection plate 113.

To ensure that the refrigerant introduced though the introduction port 125 applies pressure to the connection plate 113 to stably move the connection plate 113, the booster 100 may include a guide plate 120 installed inside the casing 115 in a protruding manner. The guide plate 120 may have a length corresponding to the distance by which the connection plate 113 moves. In addition, to form a passage 124 of flow of the refrigerant, one side of the guide plate 120 may not be attached to the casing 115.

To ensure that the blocking plate 110 stably moves to vary the cross-sectional area of the header 41, the booster 100 may include guide protrusions 117 and 118 protruding into the header 41. The guide protrusions 117 and 118 may include an upper guide protrusion 118 supporting the upper portion of the blocking plate 110 and a lower guide protrusion 117 supporting the lower portion of the blocking plate 110. The guide protrusions 117 and 118 may horizontally fix the blocking plate 110 pressed upward or downward by the refrigerant moving upward or downward.

The booster 100 may be fabricated as an assembly separate from the header 41 and attached to one side of the header 41. The header 41 may be provided with an opening into which the introduction port 125 and the blocking plate 110 are inserted for installation of the booster 100. By inserting the blocking plate 110 into the opening and attaching the casing 115 to the header 41, the booster 100 may be installed at the header 41.

The blocking plate 110 is designed to have a length shorter than the diameter of the header 41 such that the refrigerant may flow in the header 41 even when the blocking plate 110 is maximally inserted into the header 41. The refrigerant flowing along the header 41 passes through the introduction port 125 and applies pressure to the connection plate 113 via the passage 124. Thereby, the blocking plate 110 and the elastic unit 112 may move to vary the cross-sectional area of the header 41. The modulus of elasticity of the elastic unit 112 may be designed to adjust the range of variation of the cross-sectional area of the header 41.

In the case that the compressor 7 is operated at a relatively low rate of rotation, the internal pressure of the header 41 increases and, accordingly, the internal pressure of the casing 115 also increase. Therefore, a relatively high pressure is applied to the connection plate 113, the elastic unit 112 contracts, and the blocking plate 110 narrows the passage through which the refrigerant in the header 41 passes. The velocity of flow of the refrigerant passing through the narrowed passage may increase, causing a larger amount of the refrigerant to move upward to allow uniform distribution of the refrigerant.

On the other hand, when the compressor 7 is operated at a relatively high rate of rotation, the internal pressure of the header 41 decreases, and the internal pressure of the casing 115 also decreases. Accordingly, a relatively low pressure is applied to the connection plate 113, and the elastic unit 112 extends. Accordingly, the blocking plate 110 widens the passage through which the refrigerant in the header 41 passes. The velocity of flow of the refrigerant passing through the widened passage may decrease, causing a larger amount of the refrigerant to move downward to allow uniform distribution of the refrigerant.

The space in which the elastic unit 112 is positioned may contain a gas that may expand and contract depending on pressure, and may communicate with the first refrigerant pipe 43 or a suction pipe of the compressor 7.

As is apparent from the above description, a booster to vary the cross-sectional area of a header according to one embodiment of the present disclosure may allow a refrigerant flowing through a header to be effectively distributed to a plurality of refrigerant tubes.

In addition, the booster operated using fluid pressure of the refrigerant may eliminate necessity of a separate control device.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A heat exchanger comprising:

a plurality of refrigerant tubes disposed spaced apart from each other;

a header joined to both ends of each of the refrigerant tubes;

at least one baffle to block a longitudinal flow of a refrigerant flowing in the header and divide the refrigerant tubes into a plurality of mutually adjacent groups, each of the groups causing the refrigerant to flow in one direction; and a booster installed to vary a cross-sectional area of the header to uniformly distribute the refrigerant to refrigerant tubes in the same group among the refrigerant tubes, the booster comprising a blocking plate movable within the header to vary a cross-sectional area of the header dependent on an internal pressure of the header, whereby when the internal pressure of the header increases the blocking plate is configured to move within the header to reduce the cross-sectional of the header.

2. The heat exchanger according to claim 1, wherein the booster further comprises:

a casing installed at one side of the header, the blocking plate being positioned inside the casing and installed to be movable into the header; and an elastic unit to elastically bias the blocking plate.

3. The heat exchanger according to claim 2, wherein the blocking plate is positioned at a location where the refrigerant tubes are divided into different groups.

4. The heat exchanger according to claim 2, wherein the booster comprises an introduction port connecting the header to the casing to allow the refrigerant flowing in the header to enter the casing.

5. The heat exchanger according to claim 4, wherein the booster further comprises a connection plate to move according to introduction of the refrigerant into the casing through the introduction port, wherein one side of each of the blocking plate and the elastic unit is fixed to the connection plate such that the blocking plate and the elastic unit move along with the connection plate.

6. The heat exchanger according to claim 5, wherein the booster further comprises a guide plate installed inside the casing in a protruding manner to allow the refrigerant introduced through the introduction port to apply pressure to the connection plate to cause the connection plate to stably move.

7. The heat exchanger according to claim 2, wherein the booster comprises a guide protrusion positioned at upper and lower portions of the blocking plate and protruding into the header to allow the blocking plate to stably move.

8. An air conditioner comprising:

a compressor to compress and discharge a gaseous refrigerant;

an expansion valve to expand a condensed liquid refrigerant; and a heat exchanger provided with a plurality of refrigerant tubes disposed spaced apart from each other and a header joined to both ends of each of the refrigerant tubes, wherein the header comprises at least one baffle to block a longitudinal flow of a refrigerant flowing in the header and a booster installed to vary a cross-sectional area of the header, and wherein the booster comprises a blocking plate movable within the header to vary a cross-sectional area of the header dependent on an internal pressure of the refrigerant flowing in the header, whereby when the internal pressure of the header increases the blocking plate is configured to move within the header to reduce the cross-sectional of the header.

9. The air conditioner according to claim 8, wherein the booster further comprises an elastic unit to elastically bias the blocking plate.

10. The air conditioner according to claim 8, wherein the blocking plate is positioned at one side of the header and arranged between the refrigerant tubes disposed spaced apart from each other.

11. A heat exchanger comprising:

a plurality of refrigerant tubes;

a header to connect ends of the plurality of refrigerant tubes;

a booster installed to vary a cross-sectional area of the header, wherein the booster comprises a blocking plate movable within the header to vary a cross-sectional area of the header dependent on an internal pressure of the header, the booster being configured to reduce a cross-sectional area of the header when the internal pressure of the header is relatively high and to increase the cross-sectional area of the header when the internal pressure of the header is relatively low.

12. The heat exchanger according to claim 11, wherein the booster comprises:

a casing installed at one side of the header, the blocking plate being positioned inside the casing and installed to be movable into the header; and an elastic unit to elastically bias the blocking plate.

13. The heat exchanger according to claim 12, wherein the booster further comprises an introduction port connecting the header to the casing to allow the refrigerant flowing in the header to enter the casing.

14. The heat exchanger according to claim 13, wherein the booster further comprises a connection plate to move according to introduction of the refrigerant into the casing through the introduction port, wherein one side of each of the blocking plate and the elastic unit is fixed to the connection plate such that the blocking plate and the elastic unit move along with the connection plate.

15. The heat exchanger according to claim 14, wherein the booster further comprises a guide plate installed inside the casing in a protruding manner to allow the refrigerant introduced through the introduction port to apply pressure to the connection plate to cause the connection plate to stably move.

* * * * *